US005396964A

United States Patent [19]

Shellhorn et al.

[11] Patent Number: 5,396,964

[45] Date of Patent: Mar. 14, 1995

[54] APPARATUS AND METHOD FOR PROCESSING SOIL IN A SUBTERRANEAN EARTH SITUS

[75] Inventors: Verne L. Shellhorn, Gualala, Calif.; Max A. Gibbs; Clinton W. Cole, both of Duncan, Okla.

[73] Assignee: Halliburton Company, Duncan, Okla.

[21] Appl. No.: 955,581

[22] Filed: Oct. 1, 1992

[51] Int. Cl.[6] ..... E21B 3/04

[52] U.S. Cl. ..... 175/195; 173/42; 173/44; 175/162; 405/232

[58] Field of Search ..... 405/232, 230, 231; 175/162, 195; 173/185, 28, 44, 42, 190, 193

[56] References Cited

U.S. PATENT DOCUMENTS

| | | | |
|---|---|---|---|
| 512,037 | 1/1894 | Kraus . | |
| 1,313,013 | 8/1910 | Polysu . | |
| 1,665,798 | 4/1928 | Sipe . | |
| 1,734,672 | 11/1929 | Harralson . | |
| 1,904,079 | 4/1933 | Powell . | |
| 2,129,978 | 9/1938 | Yokoyama . | |
| 2,199,692 | 5/1940 | Catland . | |
| 2,218,130 | 10/1940 | Court . | |
| 2,354,936 | 8/1944 | Bignell . | |
| 2,357,835 | 9/1944 | Leissler . | |
| 2,582,312 | 1/1952 | Del'Homme . | |
| 2,610,029 | 9/1952 | Moon | 173/185 X |
| 2,631,013 | 3/1953 | Darin | 173/185 X |
| 2,782,605 | 2/1957 | Wertz et al. . | |
| 2,923,133 | 2/1960 | Muller . | |
| 2,924,948 | 2/1960 | Mueller . | |

(List continued on next page.)

FOREIGN PATENT DOCUMENTS

| | | | |
|---|---|---|---|
| 0261189 | 10/1990 | Japan | 175/162 |
| 2106953 | 4/1983 | United Kingdom | 175/162 |
| 0861534 | 9/1981 | U.S.S.R. | 175/162 |

OTHER PUBLICATIONS

Brochure dated 1988 of Geo-Con, Inc., entitled "Geo-Con DSM System . . . when conventional methods of soil improvement fall short".

Publication of S. M. W. Seiko, Inc., entitled "New SMW TM Cutoff Wall Technique There Is Nothing Like It", (undated).

*Primary Examiner*—Dennis L. Taylor

*Attorney, Agent, or Firm*—Robert A. Kent; Neal Kennedy

[57] ABSTRACT

An apparatus for processing soil in a subterranean earth situs. The apparatus includes a parallelogram spotter or positioning portion with a drilling table support portion connected thereto. A rotary drilling table is mounted on the drilling table support portion. Relative movement is provided between the support portion and the positioning portion in a plurality of planes. A pivotation portion is disposed between the support portion and the positioning portion and pivotally connected thereto. Hydraulic cylinders are provided to shift the apparatus about a vertical axis, to move the drilling table support portion in a longitudinal direction, to tilt the pivotation portion and support portion about a horizontal axis and to tip the support portion with respect to the pivotation portion about a longitudinal axis. A table elevation winch is mounted on the support portion and has a table elevation cable extending therefrom which is engaged with a pulley connected to the support portion. A servo system is provided to sense angular displacement of the cable with respect to the pulley and to actuate the hydraulic cylinders to compensate for this angular displacement. Several soil processor embodiments are disclosed, as are methods of use.

18 Claims, 13 Drawing Sheets

U.S. PATENT DOCUMENTS 3,017,708 1/1962 Gardner ..... 173/185 X
3,097,492 7/1963 Salassi .
3,099,911 8/1963 Turzillo .
3,206,935 9/1965 Phares .
3,354,656 11/1967 Fahnestock .
3,354,657 11/1967 Turzillo .
3,363,422 1/1968 Turzillo .
3,363,706 1/1968 Feenstra ..... 175/340
3,369,617 2/1968 Brack et al. ..... 175/62
3,410,095 11/1968 Turzillo et al. .
3,426,538 2/1969 Turzillo .
3,429,126 2/1969 Wey .
3,464,216 9/1969 Turzillo .
3,470,701 10/1969 Turzillo .
3,485,052 12/1969 Turzillo .
3,504,497 4/1970 Turzillo .
3,516,183 6/1970 Serota ..... 175/162 X
3,529,428 9/1970 Batten .
3,530,675 9/1970 Turzillo .
3,563,324 2/1971 Lauber ..... 175/393
3,604,214 9/1971 Turzillo .
3,685,303 8/1972 Turzillo .
3,746,105 7/1973 Farmer et al. ..... 173/185 X
3,753,597 8/1973 French ..... 299/81
3,786,641 1/1974 Turzillo .
3,800,544 4/1974 Nakanishi .
3,802,208 4/1974 Granholm et al. .
3,842,608 10/1974 Turzillo .
3,864,923 2/1975 Turzillo .
3,935,910 2/1976 Gaudy et al. ..... 175/17
3,938,344 2/1976 Asayama .
3,962,879 6/1976 Turzillo .
4,063,424 12/1977 Takagi et al. .
4,084,648 4/1978 Yahiro ..... 175/67
4,106,225 8/1978 Schnabel ..... 405/230 X
4,126,007 11/1978 Mars ..... 405/271
4,180,350 12/1979 Watts ..... 405/233
4,212,565 7/1980 Watabe ..... 405/269
4,229,122 10/1980 Ballantyne ..... 405/258
4,302,132 11/1981 Ogawa et al. ..... 405/269
4,303,136 12/1981 Ball ..... 175/329
4,327,507 5/1982 Volbeda ..... 37/67
4,433,943 2/1984 Pao Chen ..... 405/241
4,452,324 6/1984 Jürgens ..... 175/393
4,452,551 6/1984 Arndt et al. ..... 405/264
4,514,112 4/1985 Sano et al. ..... 405/269
4,515,227 5/1985 Cerkovnik ..... 175/65
4,540,316 9/1985 Takahashi ..... 405/264
4,601,613 7/1986 Wolf ..... 405/239
4,637,758 1/1987 Tamaki et al. ..... 405/248
4,659,257 4/1987 Verstraeten ..... 405/248
4,793,740 12/1988 Schellhorn ..... 405/232
4,958,962 9/1990 Schellhorn ..... 405/267
5,135,058 8/1992 Millgard et al. ..... 175/71
5,169,183 12/1992 Hallez ..... 285/334
5,240,278 3/1966 Witwer ..... 173/185

APPARATUS AND METHOD FOR PROCESSING SOIL IN A SUBTERRANEAN EARTH SITUS

BACKGROUND OF THE INVENTION

1. Field of the Invention

This invention relates to apparatus and methods of processing soil in a subterranean earth situs, and more particularly to a spotting apparatus for quickly positioning a soil processor in a precise location for rapid drilling and processing of the soil. The apparatus also relates to new embodiments of soil processors.

2. Description of the Prior Art

A variety of methods for improving the strength and reducing the permeability of subterranean earth situs have been developed heretofore. Typically, the soil in the situs in loosened and a modifying agent is admixed therewith, in situ. This has been previously carried out by drilling an auger-type tool into the situs and pumping the solidifying agent into the soil through a shaft of the tool. The solidifying agent is typically admixed with the soil by the mechanical mixing agent of the tool, such as the auger flight upon rotation of the tool. The tool is then withdrawn from the situs with or without excavating soil therefrom. The solidifying agent/soil admixture is allowed to harden into a solidified mass. If desired, a structural element can be installed into the situs before the solidifying agent/soil admixture hardens. The resulting element and/or solidifying mass can be used to support roadways, bridges, piers, buildings and the like.

In U.S. Pat. No. 4,958,962 to Schellhorn, assigned to the assignee of the present invention, a method of modifying the structural integrity of material in a subterranean earth situs is disclosed. In accordance with that method, the structural integrity of material in the situs can be either increased or decreased. Material is particularly suitable for increasing the load-bearing capacity of a subterranean earth situs and installing structural elements, such as piles, piers and tension anchors therein. A very uniform admixture of a modifying agent and the material in the situs is achieved. The load-bearing capacity of the material in the situs can be determined before, and as, the method is carried out, allowing the overall extent of modification from point to point within the situs to be accurately controlled. The present invention can be used for carrying out this method.

In the implementation of pile systems prior to that shown in U.S. Pat. No. 4,958,962, in which a shaft is drilled and a pile driven therein, the length of time to spot the shaft/pile at the proper location is minimal relative to the length of time to drill the hole or drive the pile in. That is, the drilling and driving time of this prior method is so long relatively, that the time taken to position the tool to drill the shaft and drive the pile is not particularly significant.

However, in the system described in U.S. Pat. No. 4,958,962, the method is many times faster than the prior conventional systems. In such a case, the spotting or positioning speed becomes a critical item in productivity. That is, the time taken to spot the tool in the desired location can become significant with respect to the operation of actually creating the pile. In the apparatus of the present invention, the soil processor can be accurately and quickly positioned at the desired location and the actual drilling and processing operation carried out very quickly. Thus, a system is provided which is much more efficient and less costly than prior known systems.

Also in prior systems, there are problems involved in spotting the tool where crane access is limited, where unlevel surfaces are encountered, where the drilling location is a relatively long distance from the crane apparatus used to position the tool, and/or where the pile location is higher or lower than the rig. The apparatus of the present invention is easily used in all of these situations without difficulty.

SUMMARY OF THE INVENTION

The present invention comprises an apparatus, including a parallelogram spotter apparatus, for positioning a soil processor. The invention also comprises methods of positioning a soil processor and processing the soil and further comprises new embodiments of soil processors.

The apparatus of the invention for positioning a soil processor comprises a drilling table support portion, a rotary drilling table mounted on the drilling table support portion, a positioning portion connected to the support portion, and positioning means for providing relative movement between the support portion and the positioning portion, thereby substantially simultaneously positioning the support portion in a plurality of planes with respect to a ground surface. The apparatus further comprises a pivotation portion disposed between said support portion and said positioning portion. The pivotation portion is preferably connected to one of the positioning and support portions by a pivot having a transversely extending axis, and the pivotation portion is also preferably pivotally connected to the other of the positioning and support portions by a pivot having a substantially longitudinal axis.

The positioning means comprises hydraulic cylinder means for tilting the support portion about a transverse axis in a longitudinal plane. The positioning means may also comprise hydraulic cylinder means for tipping the support portion about a longitudinal axis in a transverse plane. The positioning means may additionally comprise hydraulic cylinder means for moving the support portion in a longitudinal direction, and the hydraulic cylinder means may further be adapted for resisting torque applied to the support portion by the rotary drilling table. The hydraulic cylinder means may further comprise a plurality of transversely spaced thrust cylinders and a flow divider for substantially equally controlling the thrust cylinders by dividing hydraulic fluid flow to and from the thrust cylinders.

The positioning means may further comprise a hydraulic control system comprising servo control means for automatically substantially maintaining the support portion in a predetermined position in response to incremental movement of the table portion. The positioning means may also be said to comprise the hydraulic cylinder means.

The servo control means preferably comprises a pulley connected to the drilling table support portion, a table disposed around the pulley and extending therefrom, and sensing means for sensing an angular displacement of the cable with respect to the pulley. The cable is operated by a table elevation winch. The sensing means may be a first sensing means for sensing angular displacement in a first plane, and the apparatus may further comprise a second sensing means for sensing another angular displacement of the cable with respect to the pulley in a second plane.

In a preferred embodiment, the sensing means comprises an arm pivotally connected to the drilling table support portion, a pad attached to the arm and positioned closely adjacent to the table elevation cable such that angular displacement thereof with respect to the pulley results in corresponding movement of the arm, and a servo valve adjacent to the arm and adapted for actuation in response to the movement of the arm.

The apparatus for positioning a soil processor may further comprise a kelly disposed through the rotary drilling table, a kelly swivel attached to an upper end of the kelly, and a guide arm extending from the kelly swivel and defining a guide opening therethrough. The table elevation cable preferably passes through the guide opening, thereby maintaining the kelly in a desired relationship with respect to the drilling table.

The apparatus for positioning a soil processor of the present invention may also be described as comprising a drilling table support portion, a rotary drilling table mounted on the drilling table support portion, a kelly extending through the drilling table support portion and adapted for receiving a soil processor on a lower end thereof, table elevation winch means for raising and lowering the support portion with respect to a ground surface and maintaining the kelly in a predetermined relationship to the rotary drilling table, and crowd winch means for controlled lowering of the kelly with respect to the ground surface. The table elevation winch means comprises a table elevation winch mounted on the drilling table support portion, a bridle adapted for connection to a boom, a table elevation pulley connected to the drilling table support portion, a table elevation cable, and the sensing means previously described. The table elevation cable is engaged with the table elevation winch, the bridle and the table elevation pulley.

The positioning portion may be described as a parallelogram spotter apparatus comprising a pair of spaced longitudinal side rails, an end rail pivotally connected to each of the side rails, a pair of rail extensions telescopingly disposed with respect to the side rails, and an end trunion pivotally connected to each of the rail extensions. The transversely spaced and longitudinally disposed thrust cylinders are connected to the end trunion and are adapted for providing relative longitudinal movement between the rail extensions and the side rails, and the spotter apparatus further comprises means for substantially equally controlling the thrust cylinders such that the thrust cylinders resist torque loading applied thereto. The means for controlling preferably comprises a flow divider for substantially equally dividing hydraulic fluid flow to and from the thrust cylinders such that the thrust cylinders such that the thrust cylinders act as one.

The present invention further includes several embodiments of new soil processors. Generally, one embodiment of the soil processor comprises a central shaft defining a central opening therethrough, a blade extending from the shaft, and a fluid jet in communication with the central opening and adapted for directing a stream of fluid therefrom substantially parallel to the blade. In one embodiment, the blade is one of a plurality of helically disposed blades which give the soil processor an end mill-like appearance. In another embodiment, a plurality of blades extend radially outwardly from the central shaft. In an additional embodiment, the blade is one of a plurality of dove-tail blades extending radially outward from the central shaft. In still another embodiment, the blades are curvilinear so that the apparatus tends to screw itself into the ground. A plurality of fluid jets jet fluid from a manifold adjacent to the curvilinear blades.

In any of the soil processor embodiments, a variety of downwardly jetting and guide tools may be utilized. Additionally, a plurality of interchangeable, hardened blade tips may be attached to the lower edge of the blade.

In at least some of the embodiments, a wave of soil is generated by rotation of the blades as they engage the soil. The fluid jets are adapted to jet outwardly at near sonic speed and engage the wave of soil and rapidly increase pore pressure in the soil to maximize mixing of the fluid with the soil.

Numerous objects and advantages of the invention will become apparent as the following detailed description of the preferred embodiments is read in conjunction with the drawings which illustrate such embodiments.

BRIEF DESCRIPTION OF THE DRAWINGS

FIGS. 3A and 3B show a side elevational view of the spotter apparatus.

FIG. 6 illustrates a longitudinally oriented servo.

DESCRIPTION OF THE PREFERRED EMBODIMENT

Figure 1A:
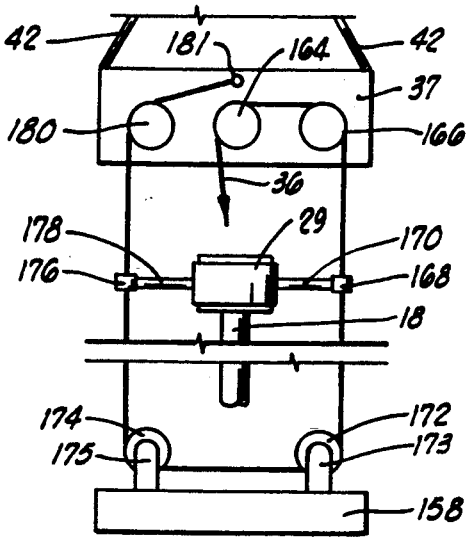
FIG. 1A is an enlargement of a portion of the cable system shown in FIG. 1.
Figure 1:
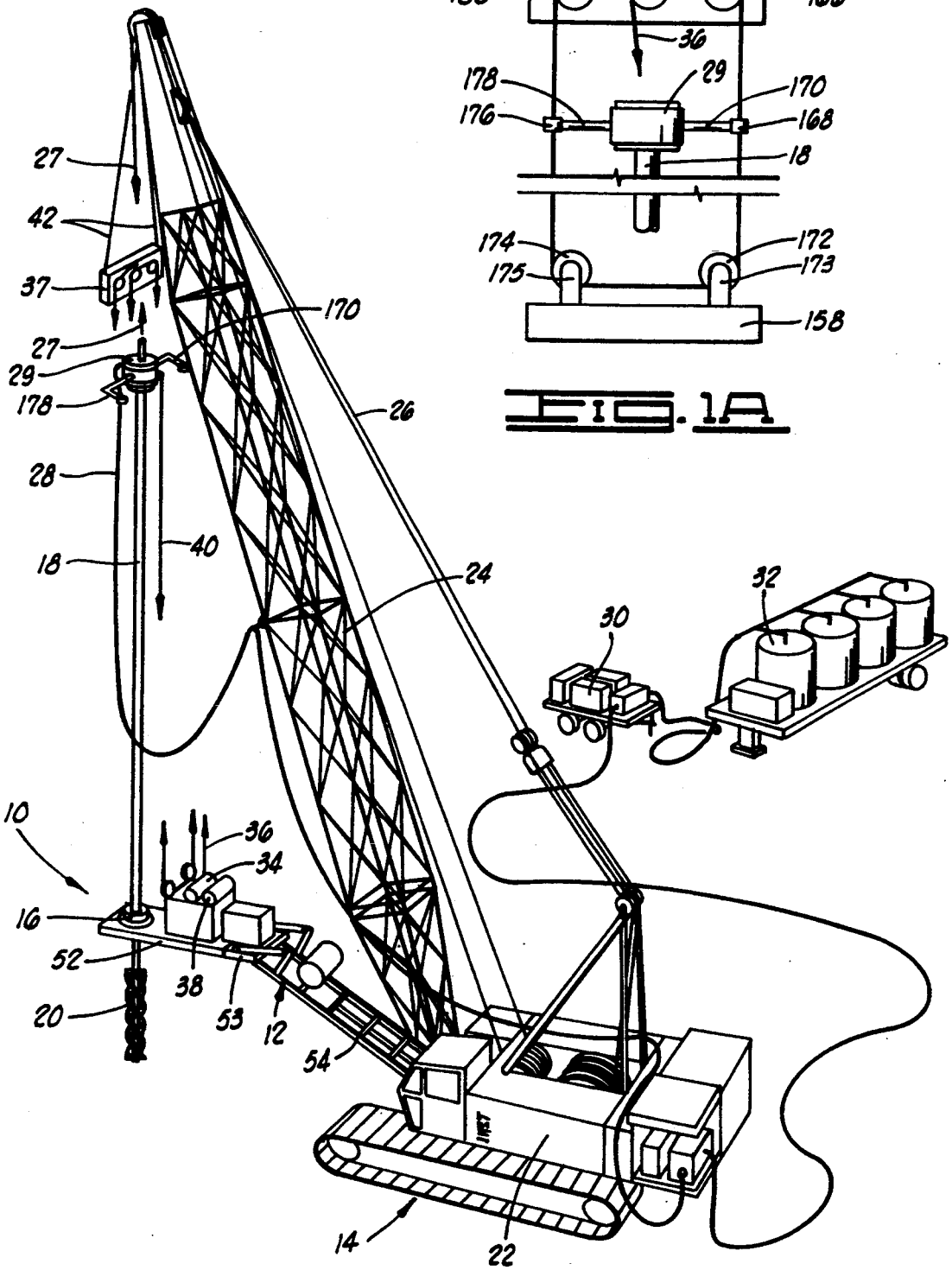
FIG. 1 shows a perspective of the apparatus for processing soil of the present invention, including a spotter which is supported and positioned by a drilling rig.

Referring now to the drawings, and more particularly to FIG. 1, the soil processing apparatus of the present invention is shown and generally designated by the numeral 10. Apparatus 10 includes a spotter 12 attached at an inboard end to a drilling rig 14. A drilling table 16 is mounted on spotter 12 adjacent to an outboard end thereof. A kelly 18 is disposed through drilling table 16 and a soil processor 20 is attached to the lower end of the kelly. As will be further discussed herein, soil processor 20 is adapted for drilling and mixing or processing the soil.

Drilling rig 14 includes a vehicular means, such as a tractor 22, with an elongated boom 24 extending therefrom. Drilling rig 14 is of a kind known in the art and uses a plurality of cables 26 to raise and lower boom 24 with respect to tractor 22.

A hose 28 extends from tractor 22 to kelly swivel 29 at the top of kelly 18. Hose 28 is in communication with a pumping system 30, such as the Halliburton HT-350 or HT-400 pump, which is used to pump a cement slurry or other fluid from a fluid source or supply 32 to kelly 18 and thus to soil processor 20.

Mounted on the top of spotter 12 are a table elevation winch 34 with a table elevation cable 36 extending therefrom to a bridle 37 (also shown in FIG. 1A) and a crowd winch 38 with a crowd cable 40 extending therefrom to kelly swivel 29. Bridle 37 is hung from boom 24 by cables 42. The arrangement of cables 38 and 40 and the operation of winches 34 and 38 will be further described herein.

SPOTTER APPARATUS

Figure 2A:
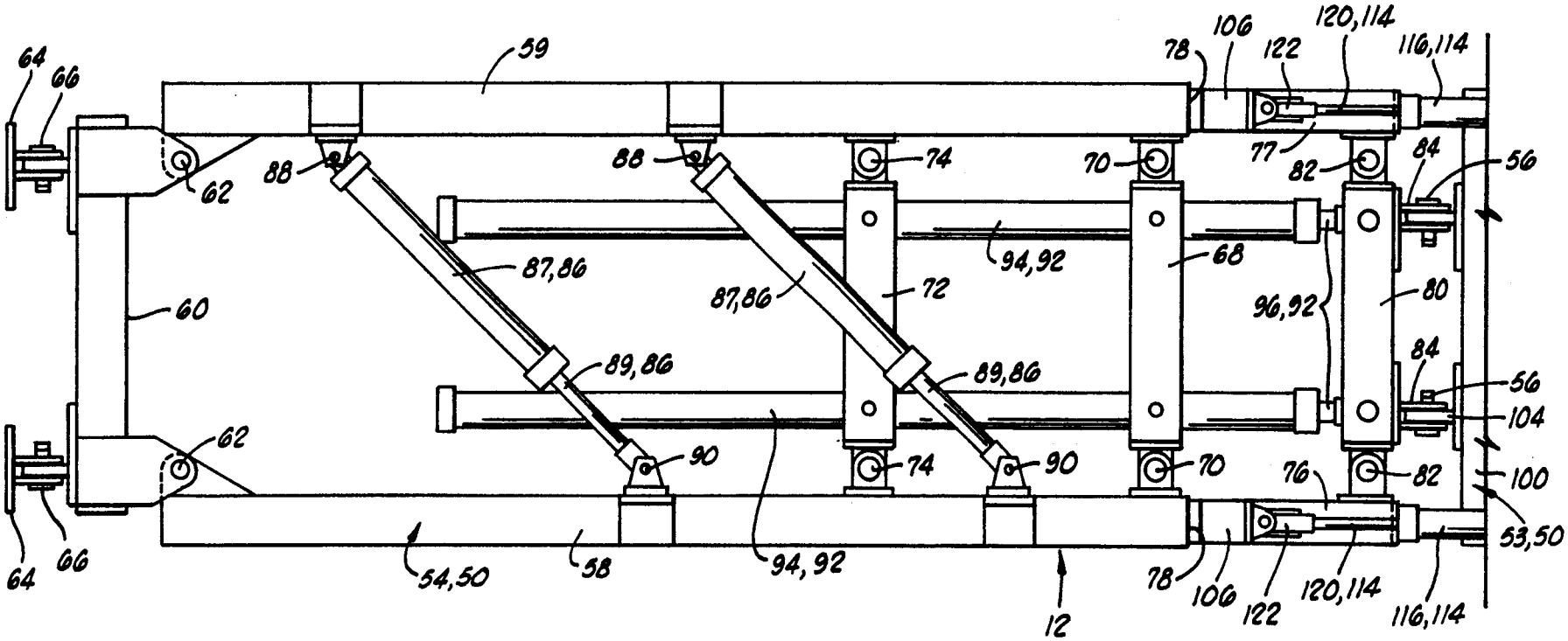
FIGS. 2A and 2B show a plan view of the spotter apparatus of the present invention.
Figure 2B:
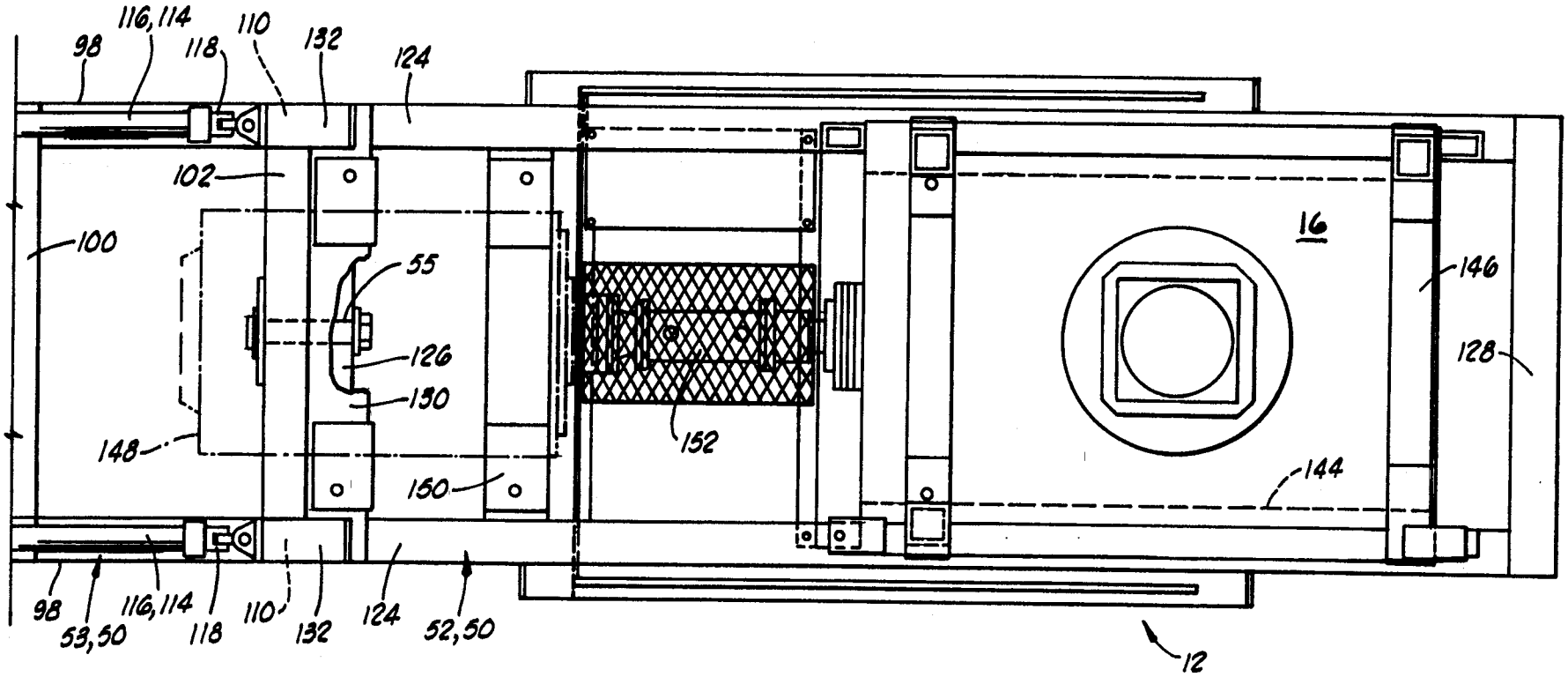
Figure 9A:
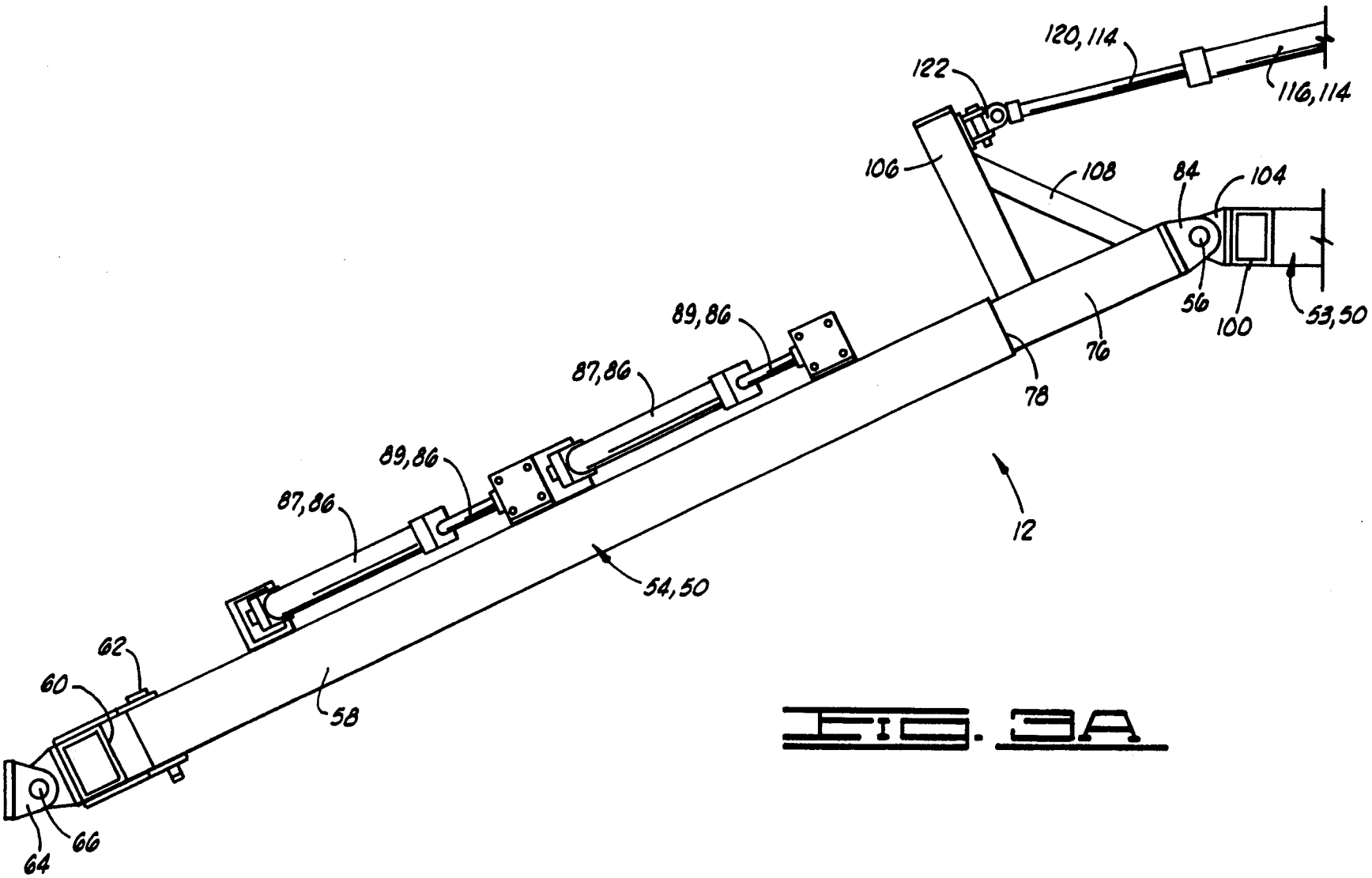
FIG. 9 shows a longitudinal cross section of a multipiece kelly.
Figure 3A:
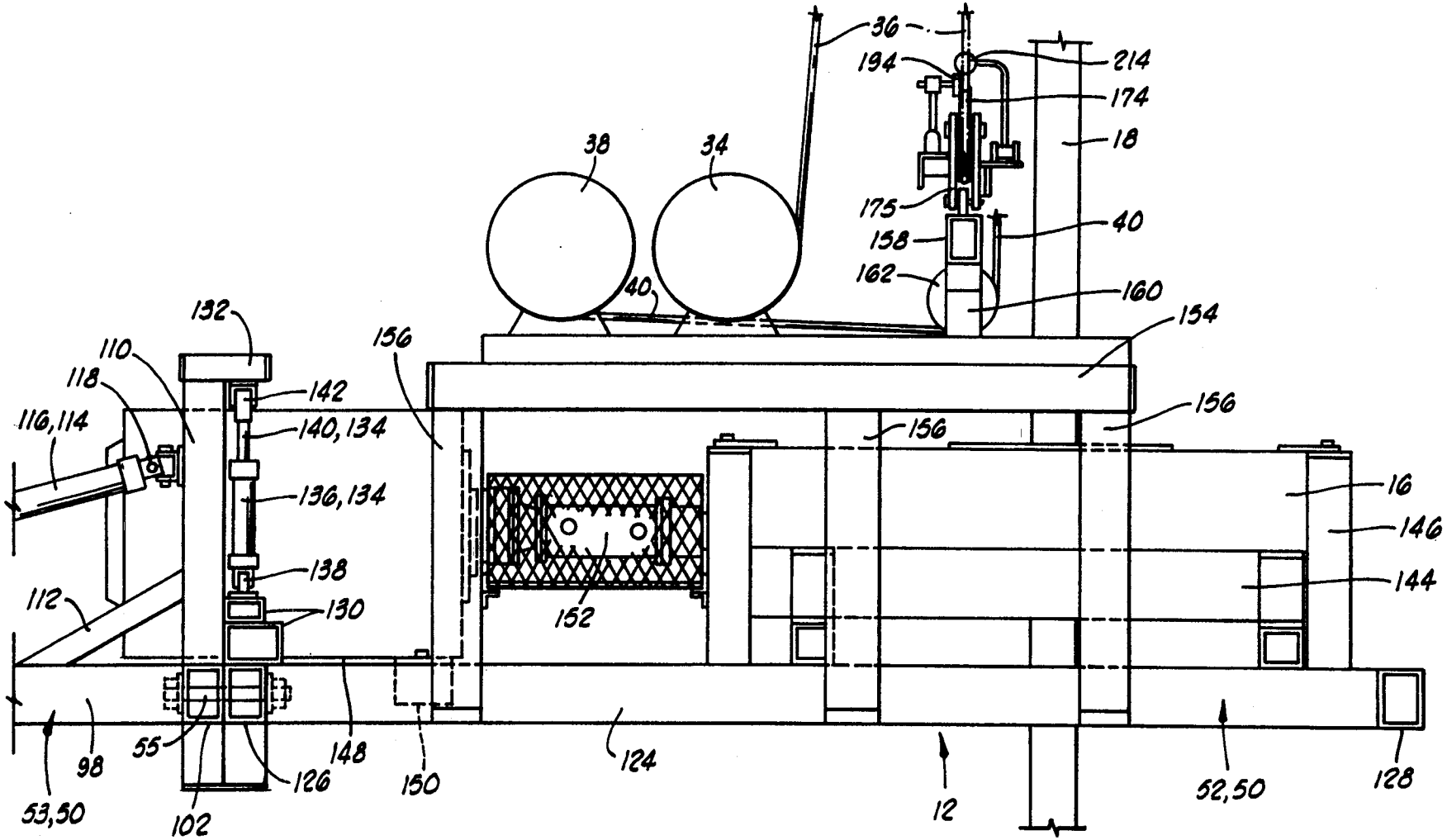

Referring now to FIGS. 2A, 2B, 3A and 3B, the details of spotter 12 will be discussed. Spotter 12 generally comprises a multi-piece frame 50 having a drilling table support portion 52 which is pivotally attached to a pivotation or intermediate portion 53 by an axial pivot pin 55. Pivotation portion 53 is pivotally attached to a positioning portion 54 at transverse pivots 56. Drilling table portion 52 is illustrated in FIGS. 2A and 3B, and positioning portion 54 is shown in FIGS. 2A and 3A. Pivotation portion 53 extends between FIGS. 2A and 2B and between FIGS. 3A and 3B.

Positioning portion 54 has a pair of longitudinally extending side rails 58 and 59 which are connected at the inboard end thereof by a transverse inboard end rail 60. End rail 60 is attached to side rails 58 and 59 at pivots 62. A pair of mounting blocks 64 are attached to the opposite side of end rail 60 at transverse pivots 66. Mounting blocks 64 are attached to drilling rig 14 in a manner known in the art, and it will thus be seen that positioning portion 54 of spotter 12 is thus pivotally connected to the drilling rig.

The outboard ends of side rails 58 and 59 are connected by a transverse end trunion 68 at pivots 70. A transverse support trunion 72 is connected to both end rails 58 and 59 at pivots 74 at a longitudinally intermediate position along the side rails.

Each side rail 58 and 59 has a hollow tubular configuration, and rail extensions 76 and 77 are telescopingly disposed in outboard end 78 of side rails 58 and 59, respectively. Rail extensions 76 and 77 extend longitudinally in an outboard direction from side rails 58 and 59. A transverse extension trunion 80 interconnects rail extensions 76 and 77 and is pivotally attached thereto at pivots 82. A pair of pivot blocks 84 are attached to the outboard side of extension trunion 80 and form a portion of pivot 56.

A pair of hydraulically actuated shift cylinders 86 are attached at an angle to side rails 58 and 59. A body 87 of each shift cylinder 86 is connected to side rail 59 at pivot 88, and a piston rod 89 of each shift cylinder 86 is connected to side rail 58 at pivot 90. By extension of shift cylinders 86, side rails 58 and 59 may be moved angularly (clockwise in FIG. 2A) about a vertical axis with respect to end rail 60. By retraction of shift cylinders 86, side rails 58 and 59 may be moved angularly in an opposite direction (counterclockwise in FIG. 2A) about a vertical axis with respect to end rail 60. Because of the pivoted connection of side rails 58 and 59 to end rail 60 and extension trunion 80, it will be seen by those skilled in the art that positioning portion 54 of frame 50 always generally forms a parallelogram. That is, side rails 58 and 59 are always substantially parallel to one another, and end rail 60 and extension trunion 80 are always substantially parallel to one another regardless of the relative position of the side rails with respect to end rail 60.

A pair of longitudinally disposed and transversely spaced hydraulically actuated thrust cylinders 92 each have a body 94 fixedly connected to end trunion 68 and support trunion 72. A piston rod 96 extends from each body 94 and is connected to extension trunion 80. It will be seen by those skilled in the art that extension of thrust cylinders 92 will cause extension trunion 80, and thus pivotation portion 53 and drilling table support portion 52, to be moved in a longitudinally outward direction along the plane of positioning portion 54 because of the telescoping action of rail extensions 76 and 77 within side rails 58 and 59, respectively. Similarly, retraction of thrust cylinders 92 will cause extension trunion 80, pivotation portion 53 and drilling table support portion 52 to be moved in a longitudinally inward direction in the plane of positioning portion 54.

Pivotation portion 53 comprises a pair of longitudinal side rails 98 joined at an inboard side by a transverse inboard end rail 100 and on the outboard side by a transverse outboard end rail 102. A pair of pivot blocks 104 are attached to the inboard side of end rail 100 and form a portion of pivot 56.

A first tilt arm 106 extends perpendicularly from each of rail extensions 76 and 77, and the first tilt arms are supported by struts 108. A pair of second tilt arms 110 extends perpendicularly from outboard end rail 102 of pivotation portion 53, and each second tilt arm 110 is supported by a strut 112.

A pair of hydraulically actuated tilt cylinders 114 have a body 116 which is attached to second tilt arm 110 by a U-joint 118. A piston rod 120 extends from each body 116 and is connected to the corresponding first tilt arm 106 by a U-joint 122. It will be seen by those skilled in the art that extension of tilt cylinders 114 will cause second tilt arm 110 to be moved angularly away from first tilt arm 106. That is, pivotation portion 53 and table support portion 52 will rotate in a counterclockwise direction (as viewed in FIGS. 3A and 3B) about the horizontal axis of pivots 56 with respect to positioning portion 54. Retraction of tilt cylinders 114 will cause rotation in the opposite direction. See arrow 123 in FIG. 4. This allows kelly 18 and soil processor 20 to be moved angularly with respect to a ground surface 125 so that the soil processor may enter the soil at any angle within the movement of the apparatus.

Referring now to FIGS. 2B and 3B, drilling table support portion 52 comprises a pair of longitudinal side rails 124 joined at an inboard end by a transverse inboard end rail 126 and at an outboard end by a transverse outboard end rail 128. Pivot pin 55 extends on a longitudinal axis through inboard end rail 126 of table support portion 52 and outboard end rail 102 of pivotation portion 53, thus making the pivoting connection between the table support portion and the pivotation portion, as previously mentioned.

Figure 5:
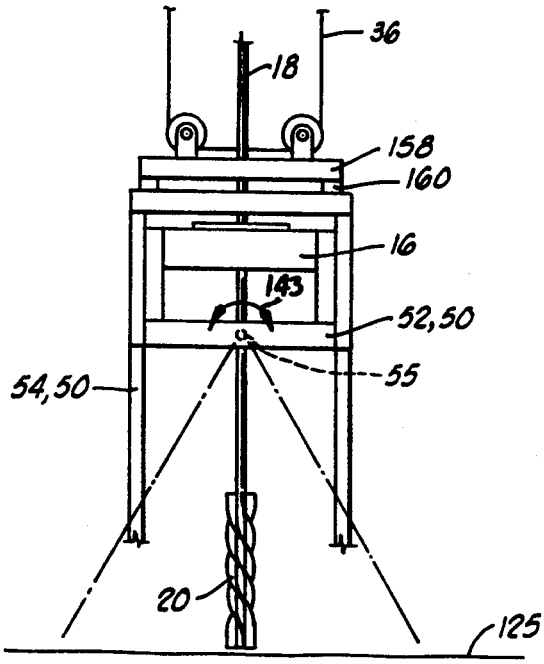
FIG. 5 schematically shows an end view of the spotter apparatus showing a plurality of tip positions.

A cylinder support 130 extends transversely above inboard end rail 126. A cylinder bracket 132 is attached to the top of each second tilt arm 110. A pair of tip cylinders 134 are disposed between cylinder support 130 and each cylinder bracket 132. Each tip cylinder 134 has a body 136 attached to cylinder support 130 by a pivot 138 and a piston rod 140 attached to a corresponding cylinder bracket 132 by a pivot 142. It will be seen by those skilled in the art that, by expansion of one cylinder 136 and corresponding retraction of the other cylinder 136, drilling table portion 52 may be rotated with respect to pivotation portion 54 about the longitudinal axis of pivot pin 55, and by reverse actuation of tip cylinders 134 may be rotated in the opposite direction. See arrow 143 in FIG. 5. FIG. 5 is an end view of spotter 12 showing different angular positions for kelly 18 and soil processor 20 by pivotation of drilling table support portion 52 about pivot pin 55.

In actuating tip cylinders 134, it should be noted that the mounting of tilt cylinders 114 with U-joints 118 and 122 allows tilt cylinders 114 to be "twisted" and thus compensate for the movement caused by tip cylinders 134. Both tilt cylinders 114 and tip cylinders 134 may be actuated substantially simultaneously.

Figure 4:
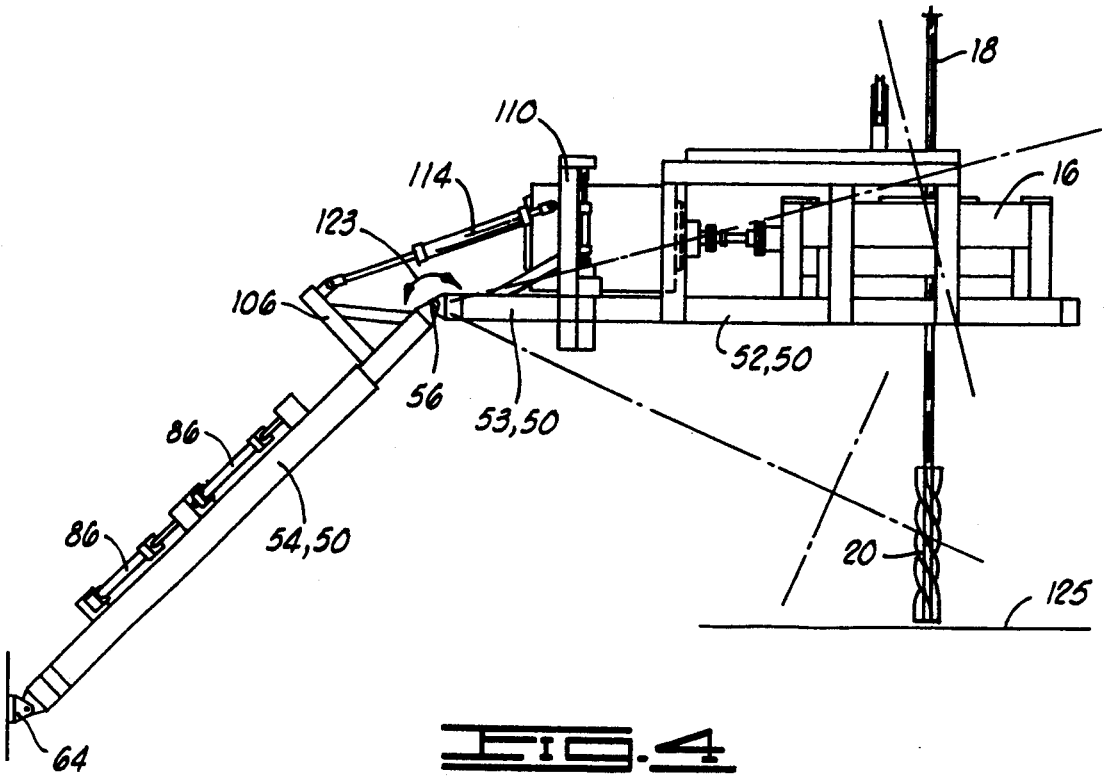
FIG. 4 schematically illustrates a side view of the spotter apparatus illustrating a plurality of tilt positions.

The movement described in FIGS. 4 and 5 show that soil processor 20 may be positioned to engage ground surface 125 at virtually any angle as viewed from any direction. This movement provided by tilt cylinders 114 and tip cylinders 134, along with the previously described movement provided by shift cylinders 86 and thrust cylinders 92, provides great flexibility in drilling and processing the soil.

It should be noted that in FIGS. 3A and 4, positioning portion 54 is shown angling upwardly with respect to mounting blocks 64, but it should be understood that this is not necessary. Positioning portion 54 may be positioned such that it extends horizontally from mounting blocks 64 or extends downwardly with respect thereto. Regardless of the angular position of positioning portion 54 with respect to mounting blocks 64, drilling table support portion 54 may be positioned in any desired relationship with respect to ground surface 125.

Drilling table 16 is positioned on a table support 144 and located by a table cage 146, both of which are attached to side rails 124 of table support portion 52. The exact configuration of table support 144 and table cage 146 is not critical to the invention, and it is only necessary that drilling table 16 be supported on frame 50.

A prime mover 148 is connected to side rails 124 of drilling table support portion 52 by a mounting bracket 150. Prime mover 148 may be of any kind known in the art, such as a hydraulic motor, an electric motor, an internal combustion engine, etc. Prime mover 148 is connected to drilling table 116, and power from the prime mover is supplied to the drilling table, in a manner known in the art by a coupling means 152.

Still referring to FIG. 3B, a winch platform 154 is disposed above a portion of drilling table 16 by a plurality of legs 156. Legs 156 are attached at their lower ends to side rails 124 of drilling table support portion 52, and thus form a portion thereof. Table elevation winch 34 and crowd winch 38 are mounted on winch platform 154. A pulley support arm 158 is spaced outwardly from crowd winch 38 and supported above winch platform 154 by legs 160. A crowd pulley 162 is disposed adjacent to pulley support arm 158, and crowd cable 140 extends from the lower side of crowd winch 138 and passes below table elevation winch 34 to wrap around crowd pulley 162 (as seen in the embodiment illustrated in FIG. 3B) and then to extend upwardly to kelly swivel 29 (as seen in FIG. 1).

Referring now to FIGS. 1, 1A and 3B, table elevation cable 36 extends upwardly from table elevation winch 34 to bridle 37. Table elevation cable 36 passes around a first bridle pulley 164, also referred to as a center bridle pulley 164, and then around a second bridle pulley 166. Table elevation cable 36 then passes through a guide 168 located at the end of an L-shaped guide arm 170 extending from kelly swivel 29. Table elevation cable 36 then passes around and under a first table elevation pulley 172 mounted on pulley support arm 158 by a pulley bracket 173. Cable 36 extends horizontally above pulley support arm 158 and wraps under and around a second table elevation pulley 174 which is also mounted on pulley support arm 158 by a pulley bracket 175. Cable 36 then extends upwardly from second table elevation pulley 174 through a second guide 176 at the end of an L-shaped second guide arm 178 extending from kelly swivel 29. Finally, table elevation cable 36 passes around a third bridle pulley 180 on bridle 37, and an end of cable 36 is fixedly attached to the bridle at an attachment point 181.

It will thus be seen by those skilled in the art that by reeling in cable 36 on table elevation winch 34, first and second table elevation pulleys 172 and 174, and thus the entire drilling table support portion 52 of spotter 12, are raised upwardly. Similarly, drilling table support portion 52 may be lowered by reeling out cable 36 from table elevation winch 34.

POSITIONING MEANS AND SERVOS

Referring to FIGS. 3B in which first table elevation pulley 172 is not shown, and also referring now to FIGS. 6 and 7, the details of a positioning means for positioning drilling table portion 52 with respect to the relative position between second table elevation pulley 174 and table elevation cable 36 will be discussed. It will be seen that FIG. 6 is essentially an enlargement of a portion of FIG. 3B.

Figure 7:
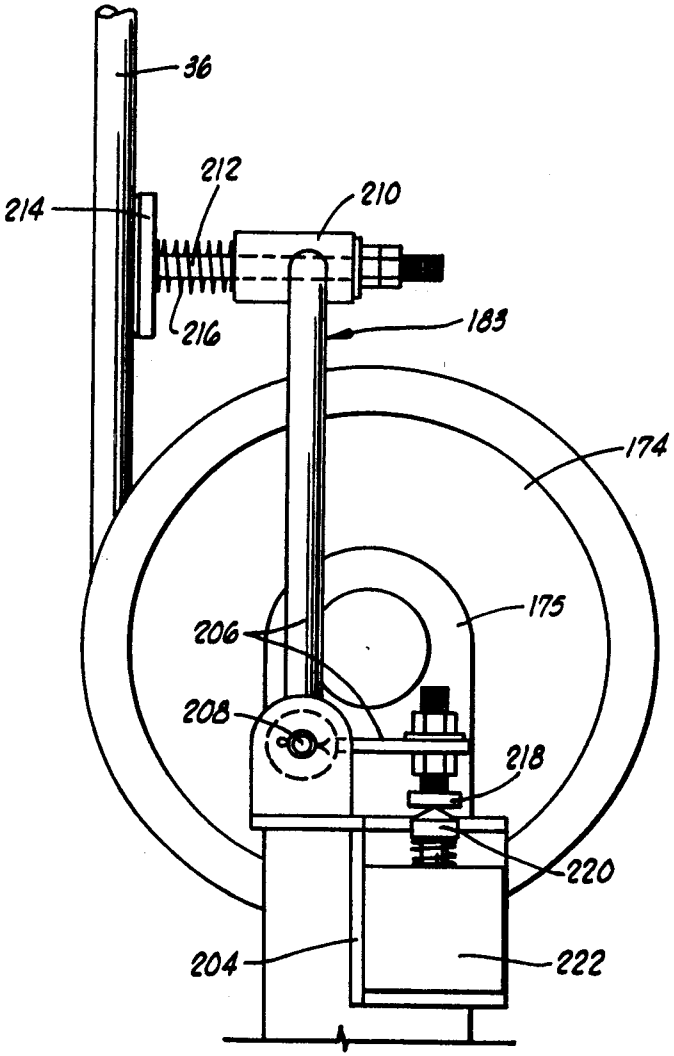
FIG. 7 illustrates a transversely oriented servo.

The positioning means comprises a first sensor means 182 shown in FIG. 6 and a second sensor means 183 shown in FIG. 7. For simplicity, second sensor means 183 is not shown in FIG. 6, and first sensor means 182 is not shown in FIG. 7.

Referring now to FIG. 6 and first sensor means 182, attached to one side of pulley bracket 175 is a first sensor bracket 184. An L-shaped sensor arm 186 is pivotally attached to first sensor bracket 184 by a pivot 188. A cylinder 190 is affixed to the distal end of a long leg of sensor arm 186, and a rod 192 is reciprocably disposed in cylinder 190. A sensor pad 194 is attached to the end of rod 192, and a biasing means, such as spring 196, biases rod 192 longitudinally from cylinder 190 so that pad 194 is always kept in engagement with table elevation cable 36 extending upwardly from second table elevation pulley 174. An actuator 198 is adjustably connected to the other, shorter leg of sensor arm 186 and is adapted for engagement with a plunger 200 of a first hydraulic servo valve 202, which may be generally referred to simply as first servo 202.

Referring now to FIG. 7 and second sensor means 183, on the opposite side of pulley bracket 175 is a second sensor bracket 204. A second sensor arm 206 is pivotally attached to second sensor bracket 204 at pivot 208. A cylinder 210 is attached to the distal end of a long leg of sensor arm 206, and a rod 212 is reciprocably disposed in cylinder 210. A sensor pad 214 is attached to the outer end of rod 212. A biasing means, such as spring 216, biases rod 212 in a transverse direction with respect to drilling table elevation portion 52, thus maintaining pad 214 in engagement with table elevation cable 36 extending upwardly from second table elevation pulley 174. An actuator 218 is adjustably attached to the shorter leg of sensor arm 206 and is adapted for engaging a plunger 220 of a second hydraulic servo valve 222, also referred to simply as second servo 202.

It will be seen by those skilled in the art that second table elevation pulley 74 is in a transverse plane which is perpendicular to, and fixed with respect to, drilling table support portion 52 of spotter 12. Thus, as drilling table support portion 52 is moved, second table elevation pulley 174 is correspondingly moved. If drilling table support portion 52 is moved such that second table elevation pulley 174 is no longer coplanar with table elevation cable 36, this relative movement between the cable and the pulley will result in corresponding movement of sensor pads 194 and/or 214, depending upon the amount and direction of movement. Because of the pivotal mounting of sensor arms 186 and 206, this movement is transmitted to first and second servos 202 and 222. That is, in looking at FIG. 6, if there is relative movement between cable 36 and pulley 174, this will be sensed by sensor pad 174 and the movement transmitted to first servo 202. Similarly, in looking at FIG. 7, relative movement of cable 36 and pulley 174 in that plane will be transmitted to second servo 222.

HYDRAULIC CONTROL SYSTEM

Figure 8:
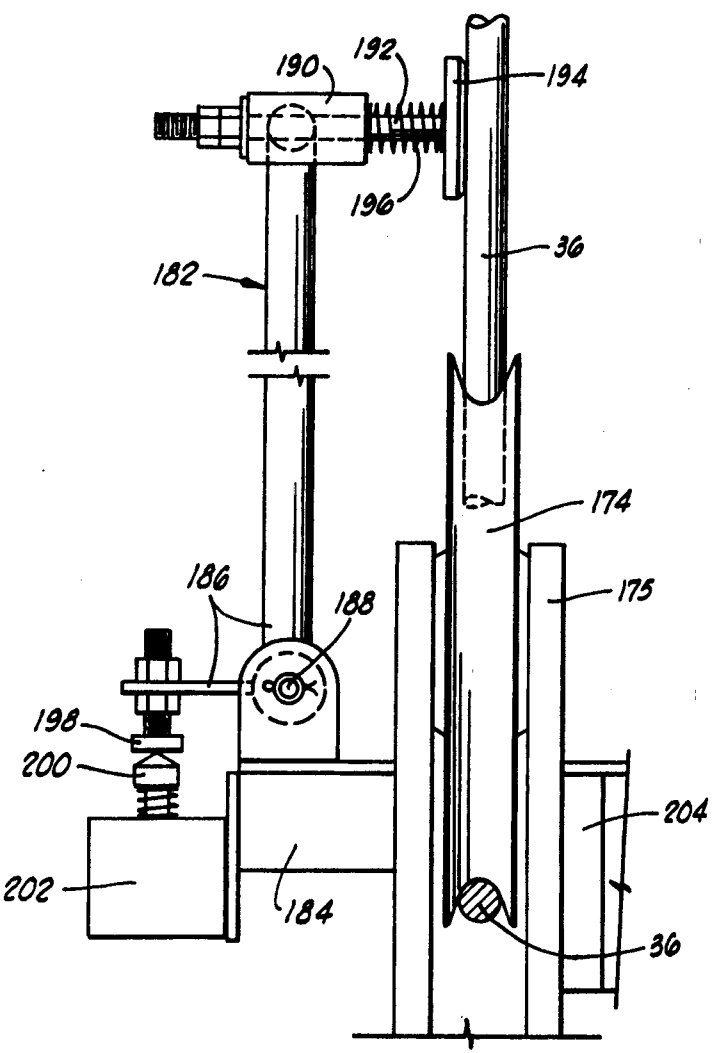
FIG. 8 is a hydraulic schematic of a control system for the spotter apparatus.
Figure 8:
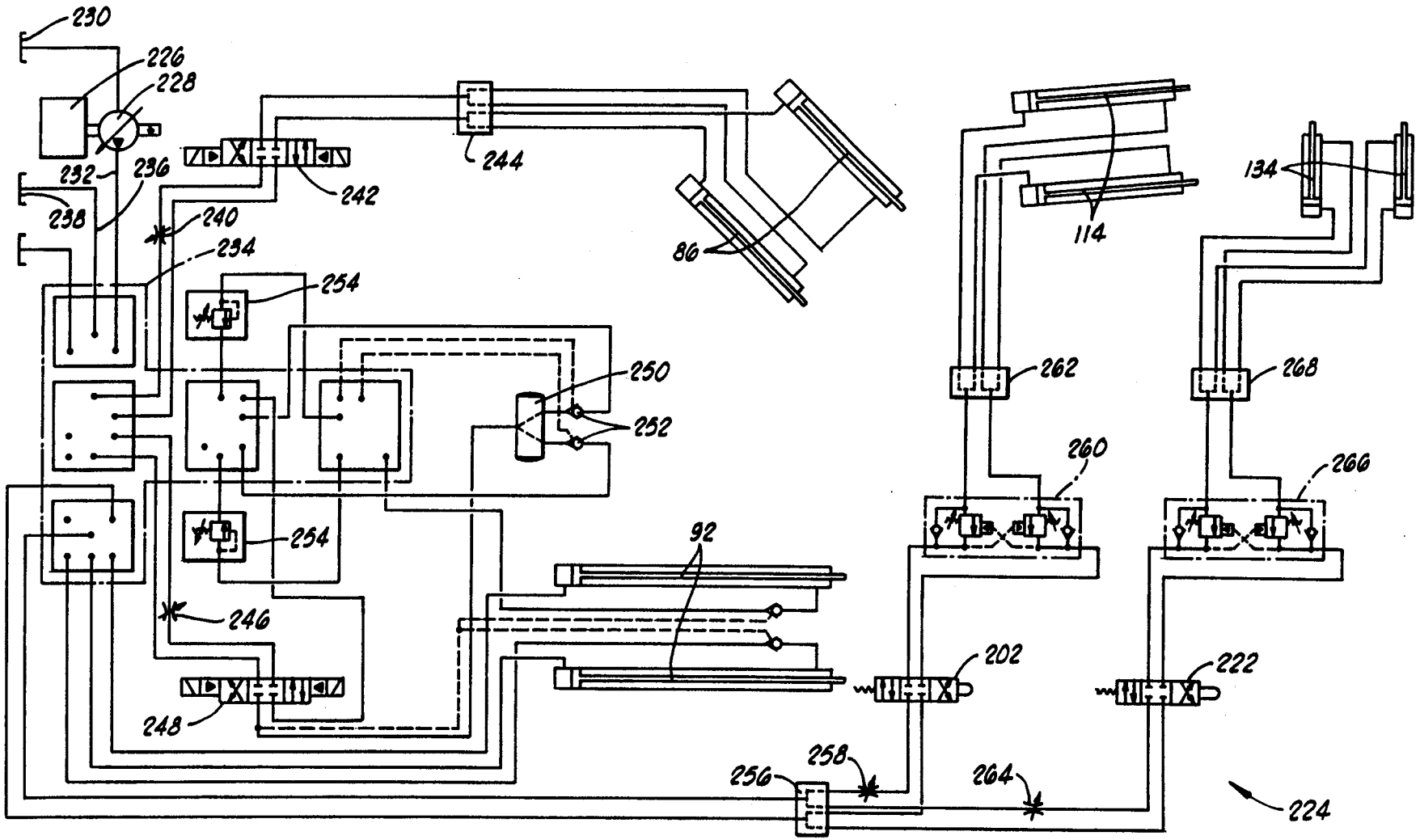

Referring now to FIG. 8, a hydraulic control system 224 is schematically shown. Hydraulic control system 224 is used to actuate shift cylinders 86, thrust cylinders 92, tilt cylinders 114 and tip cylinders 134.

A prime mover or power source 226, of a kind known in the art, is used to drive a-hydraulic power unit or pump 228. Fluid is supplied to power unit 228 from a reservoir 230 and is pumped through power unit 228 through a pressure line 232 to a hydraulic service manifold 234. A fluid return line 236 interconnects hydraulic service manifold 234 with a fluid dump location 238 which may be a part of fluid reservoir 230. Fluid is directed from hydraulic service manifold 234 to the various branches of the system which terminate with cylinders 86, 92, 114 and 134.

A fluid control valve is disposed between hydraulic service manifold 234 and a directional control valve 242 which includes a check valve. Control valve 242 is in communication with shift cylinders 86 through a hydraulic manifold 244.

A fluid control valve 246 is disposed between thrust cylinders 92 and a directional control valve 248 which includes a check valve. Fluid supplied to thrust cylinders 92 is evenly controlled by a flow divider 250 which insures that the same amount of fluid is supplied to each of thrust cylinders 92. Because thrust cylinders 92 are transversely spaced within positioning portion 54 of spotter 12, and because they are actuated substantially simultaneously by the control provided by flow divider 250, the actuation of the thrust cylinders is evenly applied to pivotation portion 53 and table support portion 52. In this way, there is no binding between rail extensions 76 and 77 with respect to side rails 58 and 59, respectively. Also, thrust cylinders withstand and counteract any torque applied to spotter 12 as a result of rotation of drilling table 16. That is, thrust cylinders 92 prevent drilling table 16 from causing rail extensions 76 and 77 to bind up within side rails 58 and 59 so that the apparatus may be extended or retracted by thrust cylinders 92 even if drilling table 16 is rotating.

A pair of pilot operated check valves provides control for flow divider 250. A pair of check valves 254 are also in communication with flow divider 250 and provide additional control for the branch of hydraulic system 224 for thrust cylinders 92.

A hydraulic manifold 256 is connected to hydraulic service manifold 234 and divides the fluid between tilt cylinders 114 and tip cylinders 134. In the branch to tilt cylinders 114, a flow control valve 258 is connected between hydraulic manifold 256 and first servo 202. A counterbalance valve 260 is disposed between first servo 202 and a hydraulic manifold 262 which in turn is connected to tilt cylinders 114.

Another flow control valve 264 is disposed between second servo 222 and hydraulic manifold 256. Another counterbalance valve 266 is disposed between second servo 222 and still another hydraulic manifold 268 which in turn is connected to tip cylinders 134.

It will be seen by those skilled in the art that the fluid flow lines are connected to shift cylinders 86 so that they always move in the same direction. The same is true for thrust cylinders 92 and tilt cylinders 114. However, fluid lines to tip cylinders 134 are reversely connected so that the tip cylinders move in the opposite direction. That is, as one tip cylinder is extended, the other is retracted, and vice versa, as previously mentioned.

MULTI-PIECE KELLY

Figure 9:
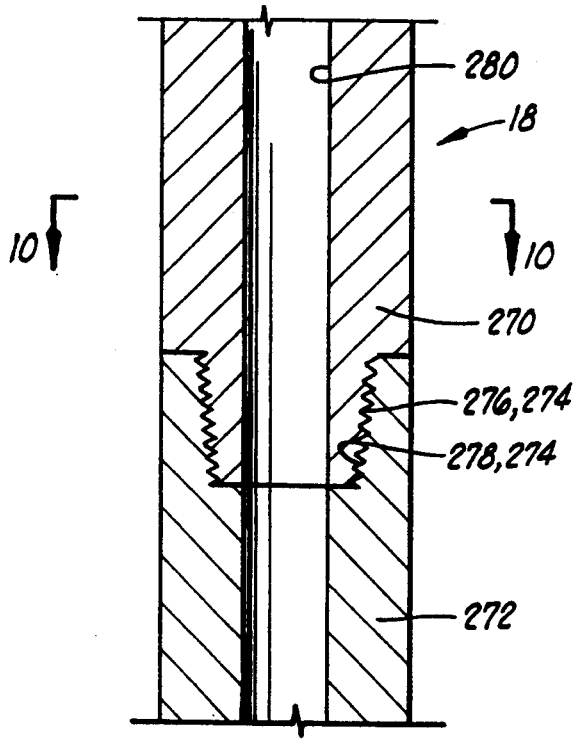
Figure 10:
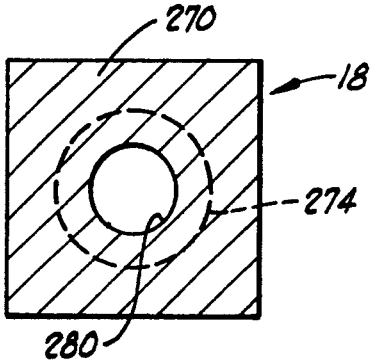
FIG. 10 shows a transverse cross section taken along lines 10—10 in FIG. 9.

Referring now to FIGS. 9 and 10, details of kelly 18 are shown. Because soil processor 20 is connected directly to kelly 18, and the depth of the hole bored by soil processor 20 may vary considerably, a standard one-piece kelly may not be sufficiently long enough to be used with spotter 12. Therefore, kelly 18 may be made of multi-piece construction.

In FIG. 9, a first kelly section 270 is shown attached to a second kelly section 272 at threaded connection 274 which is formed by the engagement of the pin end 276 of first section 270 with the box end 278 of second section 272.

As seen in FIG. 10, kelly 18 is formed with a polygonal cross-sectional shape. In the illustrated embodiment, kelly 18 is shown as square, but other shapes, such as hexagonal, could also be used. The threads on pin end 276 and in box end 278 are precisely cut such that, when first kelly section 270 is threaded into second kelly section 272, the sides of the square (or other polygon) of kelly 18 are aligned from section to section. Threaded connection 274 is thus a "timed" threaded joint so that the sides of kelly section 270 and 272 are aligned when they are threaded together and torqued to a predetermined level, such as 20,000 to 30,000 foot pounds.

Kelly 18 has a central opening 280 therethrough which is in fluid communication through kelly swivel 29 with hose 28 (see FIG. 1) so that fluid may be pumped downwardly through kelly 18 to soil processor 20.

SOIL PROCESSOR

Soil processor 20 is designed to bore a hole through the soil and to process the soil in the hole. That is, the soil broken loose in the hole is substantially thoroughly mixed with a fluid, such as a cement slurry, pumped into the hole through the soil processor. The soil processor 20 preferably is designed such that it maximizes the amount of shear applied to the soil so that the soil particle size may reduced as much as possible for better mixing with the slurry.

Figure 11:
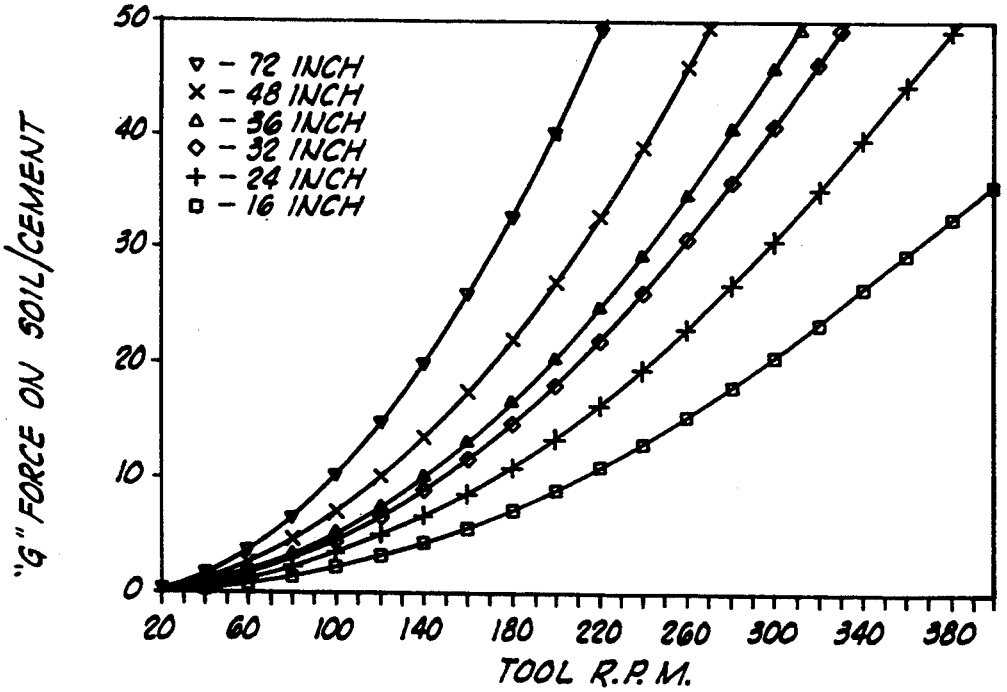
FIG. 11 is a theoretical centrifugal force chart for various sizes of soil processors operating at different speeds.

FIG. 11 illustrates theoretical centrifugal or "G" forces applied on the soil/cement mix at the outer tip diameter of the soil processor. It will be seen by those skilled in the art that the force is increased for any particular soil processor size as tool RPM is increased, and more force is applied by larger soil processors at any given speed.

Figure 12:
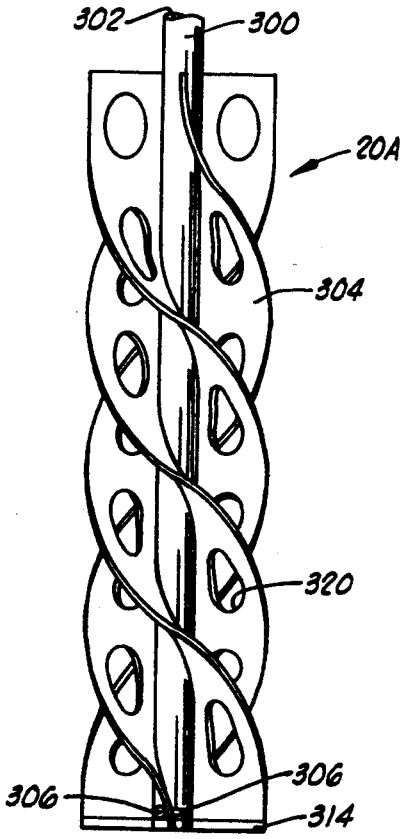
FIG. 12 illustrates a first preferred embodiment of a soil processor.

FIGS. 12–27 illustrate various embodiments and features of soil processor 20. Referring first to FIG. 12, a first soil processor embodiment, generally identified by the numeral 20A, is shown. Soil processor 20A has a central shaft 300 which is attached to kelly 18 in a known manner and has a central opening 302 defined axially therethrough and which may be closed at the lower end thereof. A plurality of intertwining helical blades 304 are attached to central shaft 300 such that soil processor 28 somewhat resembles an end mill.

At the lower end of central shaft 300 are a plurality of fluid jets 306 which are in fluid communication with central opening 302 in central shaft 300. Preferably, there is one jet 300 corresponding to each helical blade 304. Jet 306 preferably directs a fluid stream substantially perpendicular to the axis of central shaft 300 and substantially parallel to the lower end of the corresponding helical blade 304.

Figure 15:
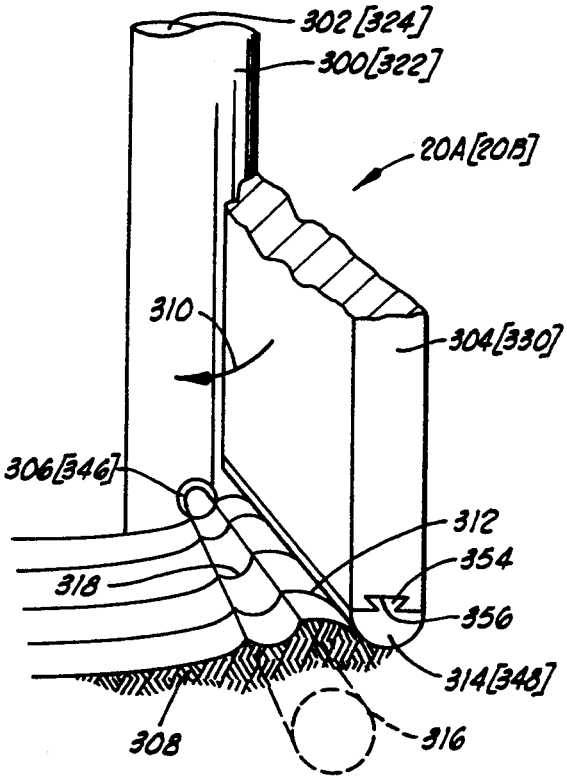
FIG. 15 is a perspective illustrating movement and jetting of soil as engaged by a soil processor, and also illustrating a rounded blade tip profile.

Referring also to FIG. 15, the relationship of jet 36 with the lower end of blade 304 is shown in more detail. When soil processor 20A is engaged with soil 308 and rotated in the direction of arrow 310, it is theorized that a wave of soil 312 is propagated in front of blade 304 adjacent to lower tip 314 of the blade. Fluid jet 306 is oriented such that a jetted stream 316 of fluid is discharged therefrom substantially parallel to lower tip 314. Preferably, jetted stream 16 engages wave 314 of soil 308 adjacent to, and preferably below, the crest of the wave. The crest of the wave presumably will have the highest amount of stress already tending to break up soil 308, and the impingement thereof by jetted stream 316 will rapidly increase the bore pressure in the soil and act to shock the soil and break it up further, thus aiding in mixing the fluid slurry with soil 308. Preferably, the fluid is jetted at near sonic velocities to maximize mixing. Although FIG. 15 illustrates jetted stream 316 as generally forming a trough 318 in wave 312 of soil 308, it is anticipated that there will actually be great turbulence in this area which will facilitate the mixing.

Referring again to FIG. 12, each helical blade 304 defines a plurality of openings 320 therethrough. The mixed soil and slurry will be forced through these openings 320 such that the openings provide a second stage of mixing after the initial jetting of fluid from jet 306.

Figure 13:
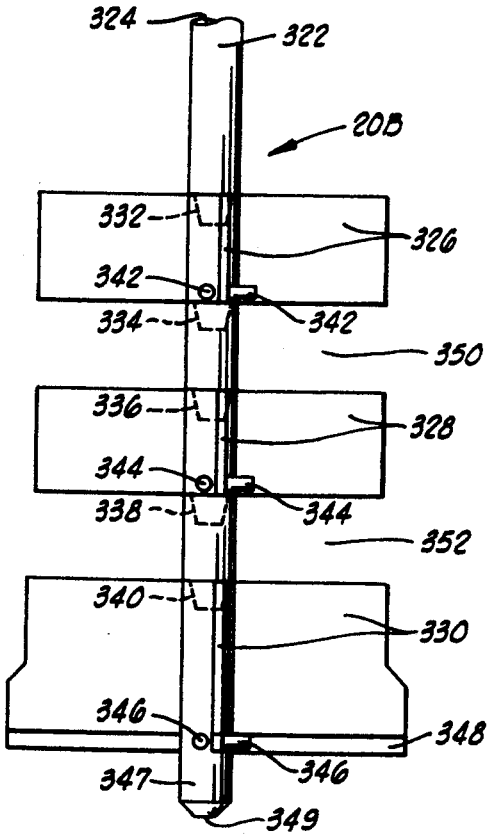
FIG. 13 shows a second embodiment of a soil processor.

Referring now to FIG. 13, a second embodiment of the soil processor is illustrated and generally designated by the numeral 20B. Soil processor 20B comprises a central shaft 322 with a plurality of blades 326, 328, 330 extending substantially perpendicularly therefrom. Central shaft 322 may be a single piece or may be formed of multiple pieces attached together by a plurality of threaded connections 332, 334, 336, 338, 340. While three blades and five threaded connections are shown in FIG. 13, the invention is not intended to be limited to any particular number or configuration.

A fluid jet 342 extends from central shaft 322 adjacent to each blade 326 and is in fluid communication with central opening 324. Similar jets 344 and 346 are positioned adjacent to blades 328 and 330, respectively. Each jet 342, 344, 346 projects a fluid stream normally from central shaft 322 and substantially parallel with the corresponding blade 326, 328, 330. For example, fluid jets 346 discharge a fluid stream adjacent and parallel to lower tip 348 of lower blade 330. This is also illustrated in FIG. 15 in which the reference numerals indicating second embodiment soil processor 20B are shown in brackets.

In the illustrated embodiment, blades 326 and 328 are separated by a gap 350, and blades 328 and 330 are separated by a gap 352. The fluid and soil mixture forced through gaps 350 and 352 will be further mixed, such that the gaps may be said to provide second stage mixing.

The illustrated embodiment shows blades 326 and 328 being slightly shorter than blades 330. The apparatus is not intended that the blades be of any particular number or have any particular length. For example, the blades could be progressively shorter starting from the top and going down, or the blades could be progressively longer starting at the top and going down. Any combination of blade configurations could be used to result in the mixing of the fluid and soil 308 as desired.

Second embodiment soil processor 20B also has a lower extension 347 on central shaft 330 which extends below blades 330. Lower extension 347 acts as a guide as soil processor 20B engages the ground and may also include a downwardly directed jet 349 which jets a stream of fluid downwardly from the tool.

Referring again to FIG. 15, it is seen that lower tip 314 of blade 304 in first embodiment soil processor 20A and lower tip 348 of blade 330 on second embodiment soil processor 20B has a rounded lower surface. Lower tips 314 and 348 are preferably made of a hardened material, such as tungsten carbide, and are intended to be removably connected to blades 304 and 330, respectively. This is accomplished by sliding an upper, generally trapezoidal, section 354 of the lower tip into a correspondingly shaped groove 356. Any fastener of a kind known in the art may be used to lock the lower tip in place as necessary.

Figure 16:
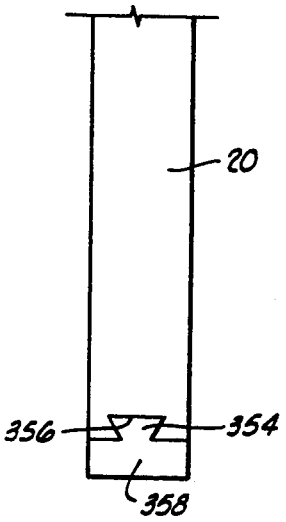
FIG. 16 illustrates a square blade tip profile.
Figure 17:
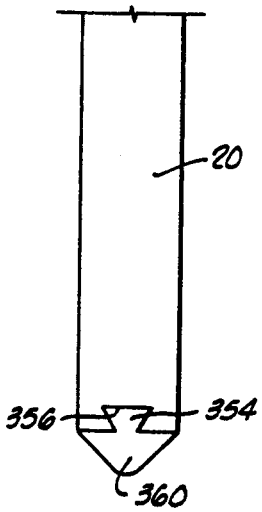
FIG. 17 shows a triangular blade tip profile.

Referring now to FIG. 16, an alternate square tip 358 is shown at the lower end of soil processor 20, and in FIG. 17, a tip 360 of generally triangular configuration is illustrated. The invention is not intended to be limited to any particular shape of lower blade tip, and the embodiments of FIGS. 15–17 are intended only to illustrate three possible configurations.

Figure 18:
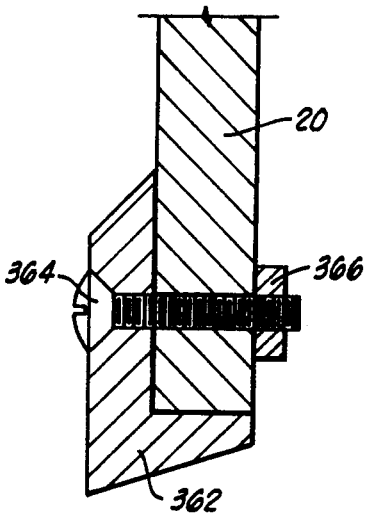
FIG. 18 shows another soil processor blade with a removable blade tip.

As seen in FIG. 18, another type of removable blade tip 362 is shown having a substantial L-shaped cross section and attached by a fastening means, such as bolt 364 and nut 366. Tip 362 may be described as a knife edge as illustrated in FIG. 18, but many different shapes could be incorporated with this mounting technique.

Figure 19:
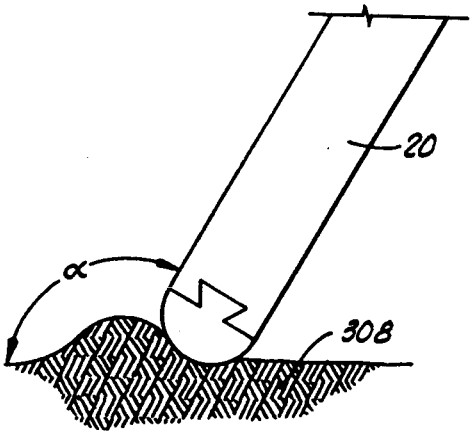
FIG. 19 illustrates a soil processor having an obtuse angle of attack.
Figure 20:
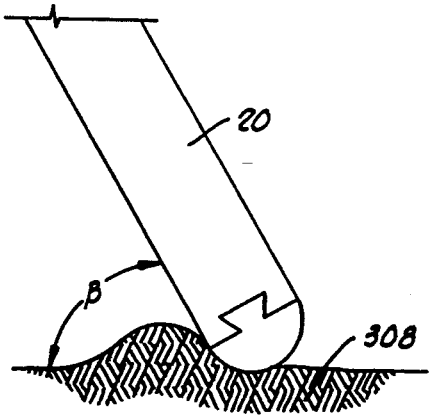
FIG. 20 illustrates a soil processor with an acute angle of attack.

FIGS. 15–18 illustrate soil processors 20 having lower blade configurations which are substantially perpendicular to the soil surface, but the invention need not be so limited. For example, soil processor 20 could engage soil 308 at an obtuse angle $\alpha$ as shown in FIG. 19 or at an acute angle $\beta$ as illustrated in FIG. 20.

Figure 14:
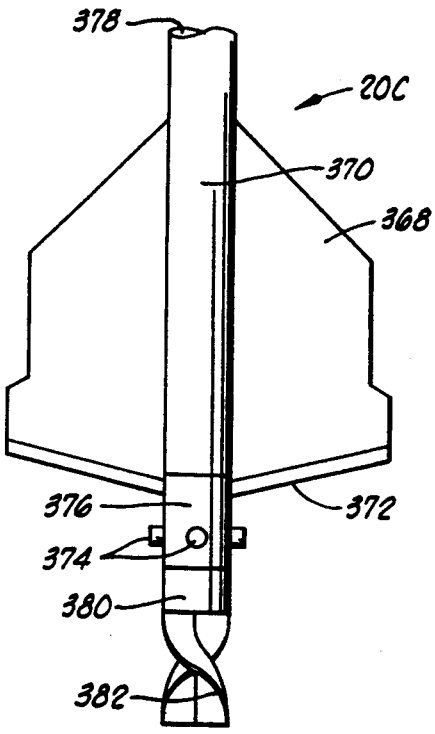
FIG. 14 illustrates a third soil processor embodiment.

Referring now to FIG. 14, a third embodiment soil processor is shown and generally designated by the numeral 20C. In this embodiment, a plurality of blades 368 extend from a central shaft 370, and the blades have an angled lower edge 372 such that soil processor 20C has on a spade-like appearance. In the illustrated embodiment, a plurality of fluid jets 374 are mounted to a shaft extension 376 and are in fluid communication with a central opening 378 through central shaft 370. Jets 374 are illustrated as spaced below lower edge 372, but the jets could be positioned adjacent to the lower edge in a manner similar to the previously described embodiments.

A lower extension 380 is connected to extension 376 and acts as a guide as soil processor 20C engages the ground. In this embodiment, lower extension 380 has a screw thread-type shape to facilitate entry into the soil. Alternatively, a lower extension, such as lower extension 347 in second embodiment soil processor 20B, could also be used. Also, a blind lower end, such as illustrated in FIG. 12 for first embodiment soil processor 20A could be used.

Lower edge 372 of blade 376 in third embodiment soil processor 20C could be formed in any of the configurations illustrated in FIGS. 15–20, just as with first and second soil processors 20A and 20B.

Referring now to FIGS. 21–27, a fourth embodiment soil processor is shown and generally designated by the numeral 20D. Soil processor 20D comprises a central shaft 390 defining a central opening 392 therethrough. A filter 393 may be disposed in central opening 392 to filter out particles in the fluid slurry as it is pumped into soil processor 20D. Central shaft 390 is connected to kelly 18 by an adapter 394.

A pair of blades 396, having a generally curvilinear cross-sectional shape, are attached to a central shaft and extend at an angle upwardly with respect thereto.

Thus, soil processor 20D may be referred to as a drill-like device having two cutting edges which slice the soil to advance the drill as it is driven in rotation and urged downwardly.

A jet block or manifold 398 is positioned adjacent to an angled upper edge 400 of each blade 396. Jet blocks 398 are also fixedly attached to central shaft 390, such as by welding.

Figure 21:
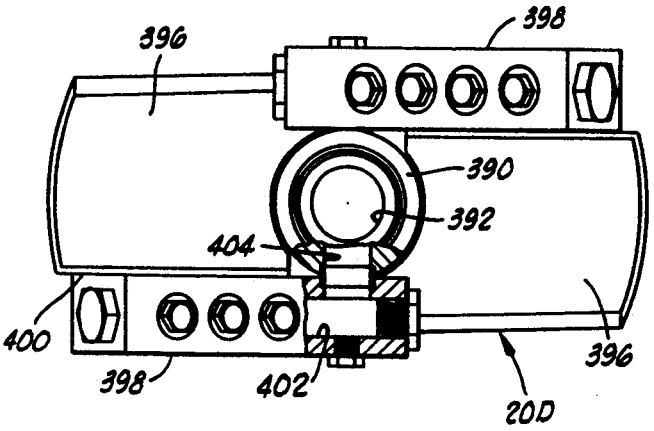
FIG. 21 is a top view of a fourth soil processor embodiment.

As best seen in FIG. 21, each jetting block 398 defines a longitudinal passageway 402 therethrough which is in communication with central opening 392 of central shaft 390 through a transverse passageway 404. Thus, it will be seen that fluid pumped down through central opening 392 is pumped into longitudinal passageways 402.

Figure 25:
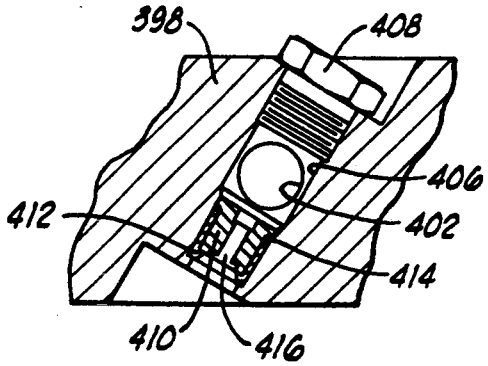
FIG. 25 is a cross section taken along lines 25—25 in FIG. 22.

Referring now to FIG. 25, a plurality of jet ports 406 are disposed angularly through jet block 398 and are in communication with longitudinal passageway 402. One side of each jet port 406 is closed by a plug 408, and a fluid jet 410 is disposed in the opposite end of jet port 406. In the illustrated embodiment, fluid jet 410 is located by a sleeve 412, and a sealing means, such as O-ring 414, provides sealing engagement between jet 410 and jet block 398.

Fluid jet 410 itself may be of a kind known in the art, such as a paint nozzle having an orifice 416 defined therein which provides a fan-shaped spray from the jet. The pattern of spray in fourth embodiment soil processor 20D is not intended to be limited to a fan-shape, and other spray patterns may also be used. When fluid jet 410 does have a fan-shaped spray pattern, it may be necessary to cut an elongated slot 418 in jet block 398 adjacent to the fluid jet so that the fluid stream does not impinge the block itself.

Figure 23:
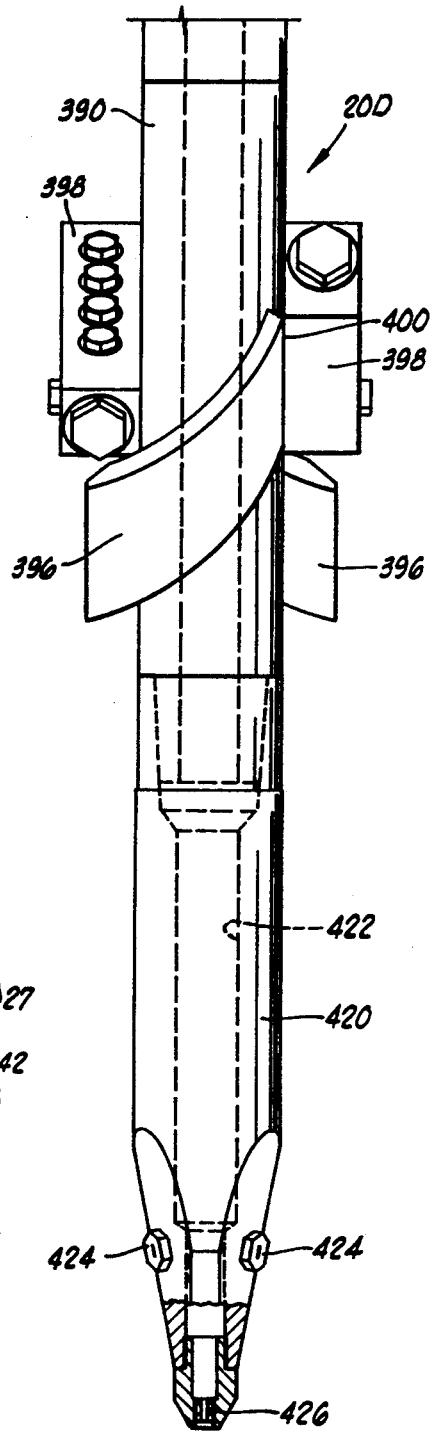
FIG. 23 shows a side view of the fourth soil processor embodiment with a pilot portion thereon.

Referring now to FIG. 23, a lower extension 420 is shown attached to the bottom of central shaft 390 to act as a guide. Lower extension 420 defines a central opening 422 therethrough which is in communication with central opening 392 in central shaft 390. The lower end of lower extension 420 forms a lobed cone shape having a plurality of fluid jets 424 disposed thereon and in communication with central opening 422. A downwardly facing jet 426 is attached to the lowermost tip and is in communication, and is coaxial, with central opening 422.

Figure 24:
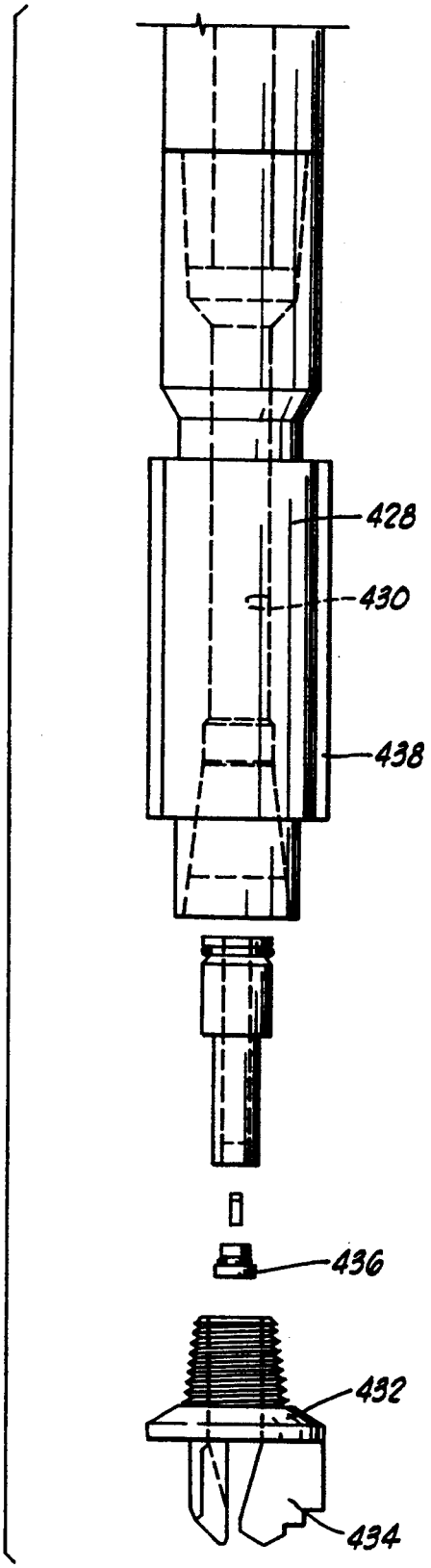
FIG. 24 illustrates an alternate pilot portion.

In FIG. 24, an alternate lower extension 428 is shown and is also adapted for connection to the bottom of central shaft 390. Lower extension 428 defines a central opening 430 therethrough which is in communication with central opening 392 in central shaft 390. A drag bit 432 is disposed at the lower end of lower extension 428 and has a plurality of teeth 434 extending downwardly therefrom which are adapted to facilitate entry of the tool into the ground. A downwardly directed fluid jet 436 provides a stream of fluid between teeth 434.

An intermediate portion of lower extension 428 defines a plurality of axial flutes 438 thereon. Preferably flutes 438 have a major diameter about equal to the major diameter of drag bit 432 which allows lower extension 428 to be closely guided in the bore produced by the drag bit. Flutes 438 are sized to allow ready passage of the slurry and soil mix generated at drag bit 432 to pass upwardly thereby.

Figure 22:
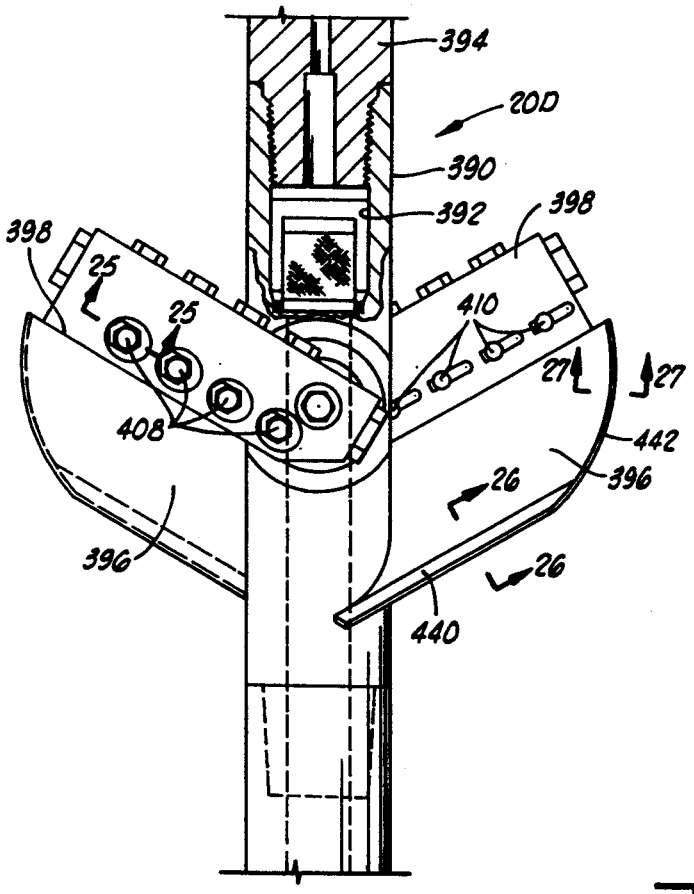
FIG. 22 is a front view of the fourth soil processor embodiment.
Figure 26:
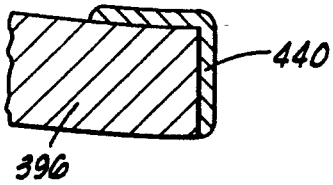
FIG. 26 is a cross section taken along lines 26—26 in FIG. 22.
Figure 27:
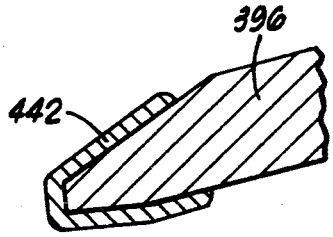
FIG. 27 is a cross section taken along lines 27—27 in FIG. 22.

Referring to FIGS. 22 and 26, blades 396 have a hardened lower edge 440 thereon. Similarly, referring to FIGS. 22 and 27, the side edges of blades 396 have hardened tips 442 thereon.

OPERATION OF THE INVENTION

Apparatus 10 is first generally located at the desired site by tractor 22. See FIG. 1. Spotter 12 and kelly 18 may be generally located in a means known in the art by movement of boom 24 controlled by cables 26 and 27. However, as generally mentioned previously herein, the positioning system for controlling movement of spotter 12 provides quick and precise positioning of soil processor 20 at any desired location. While parallelogram spotters have been used previously, none have been adapted to withstand the torque load of a drilling table 16 mounted thereon. Also, prior parallelogram spotters have not had the many different degrees of movement as in the present invention.

As drilling table support portion 52 is positioned by movement of boom 24, actuation of table elevation winch 34, and/or the positioning means including the individual or combined actuation of shift cylinders 86 and thrust cylinders 92, table elevation cable 36 may be moved out of alignment with second table elevation pulley 174. The compensation provided by the positioning means including first and second servos 202 and 222 acts to control tilt cylinders 114 and tip cylinders 134 to reposition drilling table support portion 52 such that table elevation cable 36 is maintained in the proper orientation with respect to second table elevation pulley 174. This also insures that kelly swivel 29 and kelly 18 are always held by first and second guide arms 170 and 178 in proper position with respect to drilling table 16 because table elevation cable 36 passes through guides 168 and 176 on the guide arms.

As previously described, the positioning means may also be used to control actuation of any or all of shift cylinders 86, thrust cylinders 92, tilt cylinders 114 and tip cylinders 134 to position drilling table support portion 52 at various angles with respect to ground surface 125 if desired.

When soil processor 20 is located, it is forced downwardly into the soil by reeling in crowd winch 38 which pulls crowd cable 40 downwardly, thus forcing kelly 18 and soil processor 20 downwardly. Crowd winch 38 is preferably controlled by a computer control system, such as that described in U.S. Pat. No. 4,958,962, a copy of which is incorporated herein by reference, which actuates crowd winch 38 to pull crowd line 40 in at a specific rate. If the soil provides great resistance to soil processor 20 such that crowd winch 38 is overloaded, the operator can monitor the weight on cable 27 and add all or a portion of the weight of kelly 18 and kelly swivel 29 to the soil processor in addition to the load being provided by crowd winch 38 through crowd line 40.

Substantially simultaneously with the downward movement of kelly 18 in soil processor 20, fluid is pumped through the kelly into the soil processor to mix the fluid slurry with the soil during and after the drilling process. Any of the soil processor embodiments described may be used, and it should be understood that it is not intended in this invention that spotter 12 be limited for use with any particular set of soil processor embodiments.

After the hole has been drilled and the soil and slurry mixed, kelly 18 is raised by table 27, and crowd cable 40 is correspondingly pulled out from crowd winch 38. Spotter 12 may then be positioned at another location for processing another hole in the same manner.

It will be seen, therefore, that the apparatus and method for processing soil in a subterranean earth situs of the present invention are well adapted to carry out the ends and advantages mentioned, as well as those inherent therein. While presently preferred embodiments of the apparatus and steps of the method have been described for the purposes of this disclosure, numerous changes may be made by those skilled in the art. All such changes are encompassed within the scope and spirit of the appended claims.

What is claimed is:

1. An apparatus for positioning a soil processor, said apparatus comprising:

a drilling table support portion;

a rotary drilling table mounted on said drilling table support portion;

a positioning portion connected to said support portion; and positioning means, operatively associated with said drilling table support portion and said positioning portion, for providing relative movement between said support portion and said positioning portion, thereby providing substantially simultaneous positioning of said support portion in a plurality of planes with respect to a ground surface by pivotation about a plurality of axes.

2. The apparatus of claim 1 further comprising a pivotation portion disposed between said support portion and said positioning portion, said pivotation portion being connected to one of said positioning and support portions by a pivot having an axis extending transversely with respect to said pivotation portion and being pivotally connected to the other of said positioning and support portions by a pivot having an axis extending longitudinally with respect to said pivotation portion.

3. The apparatus of claim 1 wherein said positioning means comprises hydraulic cylinder means connected to said support portion for tilting said support portion in a longitudinal plane with respect thereto.

4. The apparatus of claim 1 wherein said positioning means comprises hydraulic cylinder means connected to said support portion for tipping said support portion in a transverse plane with respect thereto.

5. The apparatus of claim 1 wherein said positioning means comprises hydraulic cylinder means connected to said support portion for moving said support portion in a longitudinal direction.

6. The apparatus of claim 5 wherein said hydraulic cylinder means is further adapted for resisting torque applied to said support portion by said rotary drilling table.

7. The apparatus of claim 5 wherein said hydraulic cylinder means comprises:

a plurality of transversely spaced thrust cylinders; and a flow divider connected to said thrust cylinders for substantially equally dividing hydraulic fluid flow to and from said thrust cylinders.

8. The apparatus of claim 1 wherein said positioning means comprises servo control means for automatically substantially maintaining said support portion in a predetermined position in response to incremental movement of said table portion.

9. An apparatus for positioning a soil processor, said apparatus comprising:

a drilling table support portion;

a rotary drilling table mounted on said drilling table support portion;

a positioning portion connected to said support portion; and positioning means, operatively associated with said drilling table support portion and said positioning portion, for providing relative movement between said support portion and said positioning portion, thereby providing substantially simultaneous positioning of said support portion in a plurality of planes with respect to a ground surface, said positioning means comprising servo control means for automatically substantially maintaining said support portion in a predetermined position in response to incremental movement of said table portion, said servo control means comprising:

a pulley connected to said support portion;

a cable disposed around said pulley and extending therefrom; and sensing means for sensing an angular displacement of said cable with respect to said pulley.

10. The apparatus of claim 9 wherein:

said sensing means is a first sensing means for sensing said angular displacement in a first plane; and further comprising a second sensing means for sensing another angular displacement of said cable with respect to said pulley in a second plane.

11. The apparatus of claim 9 wherein said sensing means comprises:

an arm pivotally connected to said support portion;

a pad attached to said arm and positioned closely adjacent to said cable such that angular displacement thereof with respect to said pulley results in corresponding movement of said arm; and a servo valve adjacent to said arm and adapted for actuation in response to said movement of said arm.

12. The apparatus of claim 9 further comprising a winch mounted on said support portion, wherein an end of said cable is connected to said winch.

13. The apparatus of claim 9 further comprising:

a kelly disposed through said rotary drilling table;

a kelly swivel attached to an upper end of said kelly; and a guide arm extending from said kelly swivel and defining a guide opening therethrough;

wherein, said cable passes through said guide opening.

14. An apparatus for positioning a soil processor, said apparatus comprising:

a drilling table support portion;

a rotary drilling table mounted on said drilling table support portion;

a kelly extending through said drilling table support portion and adapted for receiving a soil processor on a lower end thereof;

table elevation winch means in operative association with said support portion for raising and lowering said support portion with respect to a ground surface, said table elevation winch means comprising:

a table elevation winch mounted on said drilling table support portion;

a bridle adapted for connection to a boom;

a table elevation pulley connected to said drilling table support portion;

a table elevation cable engaged with said table elevation winch, said bridle and said table elevation pulley; and means for sensing angular displacement between said cable and said pulley; and crowd winch means in operative association with said kelly for controlling lowering of said kelly with respect to said ground surface.

15. The apparatus of claim 14 wherein said means for sensing comprises:

a first sensing means for sensing angular displacement between said cable and said pulley in a first plane; and second sensing means for sensing angular displacement between said cable and said pulley in a second plane.

16. The apparatus of claim 14 comprising:

a kelly swivel attached to an upper end of said kelly; and a guide arm extending from said swivel and defining a guide opening therethrough;

wherein, said table elevation cable passes through said guide opening.

17. The apparatus of claim 14 wherein:

said sensing means comprises an arm pivotally connected to said support portion;

a pad attached to an end of said arm and positioned closely adjacent to said cable such that said angular displacement results in movement of said arm; and a servo valve adjacent to said arm and adapted for actuation in response to movement of said arm.

18. An apparatus for positioning a soil processor, said apparatus comprising:

a drilling table support portion;

a rotary drilling table mounted on said drilling table support portion;

a kelly extending through said drilling table support portion and adapted for receiving a soil processor on a lower end thereof;

table elevation winch means in operative association with said support portion for raising and lowering said support portion with respect to a ground surface; and crowd winch means in operative association with said kelly for controlled lowering of said kelly with respect to said ground surface.

* * * * *